US005529486A

United States Patent [19]

Bricmont

[11] Patent Number: 5,529,486

[45] Date of Patent: Jun. 25, 1996

[54] HEATING FURNACE SYSTEM AND METHOD FOR PRODUCING HOT ROLLED WORKPIECES

[75] Inventor: Francis H. Bricmont, Pittsburgh, Pa.

[73] Assignee: Bricmanage, Inc., Pittsburgh, Pa.

[21] Appl. No.: 328,287

[22] Filed: Oct. 21, 1994

Related U.S. Application Data

[62] Division of Ser. No. 12,574, Feb. 3, 1993, Pat. No. 5,382, 159.

[51] Int. Cl.[6] ..... F27B 9/14

[52] U.S. Cl. ..... 432/124; 432/121; 432/126; 432/246

[58] Field of Search ..... 432/121, 123, 432/126, 124, 125, 132, 153, 162, 242

[56] References Cited

U.S. PATENT DOCUMENTS

| | | | |
|---|---|---|---|
| 4,164,391 | 8/1979 | Howard et al. | 432/124 |
| 4,421,481 | 12/1983 | Holz et al. | 432/126 |
| 4,741,695 | 5/1988 | Ushijima | 432/126 |
| 4,820,150 | 4/1989 | Ushijima | 432/121 |

*Primary Examiner*—Henry A. Bennet

*Assistant Examiner*—Siddharth Ohri

*Attorney, Agent, or Firm*—Clifford A. Poff

[57] ABSTRACT

A heating furnace system is provided for receiving finite lengths of workpieces from one or more continuous casters and form a supply of heated workpieces at a temperature suitable for rolling in a hot rolling mill. The system includes, in one aspect, a holding furnace receiving a workpiece during continuous casting until it is severed by a cutoff device to prevent unwanted cooling. The workpiece is fed from a holding furnace to a heating furnace wherein it is deposited onto one of a series of vertically spaced supports in a heated section where it remains static throughout the heating process. After heating the workpiece is removed from the stationary supports and returned to rollers of a hearth for discharge from the furnace to a rolling mill. In a second embodiment the holding furnace arrangement provides for separate holding furnaces to receive continuous castings from separate continuous casters and prevent unwanted cooling of the cast workpiece until cut to a finite length. The holding furnaces have doors and longitudinal sides walls to allow transfer of the workpieces seriatim through doors in a central heating furnace. The central heating furnace is aligned with the hearth as in the first embodiment and supplies workpieces serially through the heating furnace.

1 Claim, 4 Drawing Sheets

HEATING FURNACE SYSTEM AND METHOD FOR PRODUCING HOT ROLLED WORKPIECES

This application is a division of application No. 08/012574, filed Feb. 3, 1993, U.S. Pat. No. 5,382,159.

BACKGROUND OF THE INVENTION

1. Field of the Invention

The present invention relates to a heating furnace system to receive a stream of thin, continuously cast workpieces and supply such workpieces at a desired rolling temperature to a hot rolling mill, more particularly the present invention relates to such a heating furnace system having a greatly reduced floor space requirement while utilizing ancillary continuous casting and rolling mill facilities to increased limit of capacities and accommodating necessary downtimes for maintenance of such facilities.

2. Description of the Prior Art

The continuous casting of thick, e.g., 8 inches, slab workpieces gave rise to possible direct rolling of the workpieces by the use of an intermediate furnace to control the temperature of the workpiece entering the rolling mill. In recent years, the discovery of techniques that allow continuous casting of thin relatively wide workpieces of the order of between 2 and 4 inches thick and between 24 and 120inches wide, contribute to numerous beneficial advantages that are an advancement in the art. There are disadvantages arising out of the reheat furnace necessary to allow the direct rolling of the thin cast workpieces as well as more traditional continuously cast workpieces that can be greater than 4 inches thick and may range up to 10 inches thick. The thin cast workpieces can be processed in a hot rolling mill to produce hot strip product or steel plate. The thicker continuously cast product ranging between 4 and 10 inches can be rolled in a hot rolling mill to produce a hot rolled plate product or if desired more extensive hot rolling can be carried out to form a hot rolled strip. As the cast workpiece emerges from the casting facility, a torch or other cutting device subdividing the casting to form workpieces of a finite length typically approximately 80 to 150 feet long with the width varying between 24 and 120 inches. An example of a facility to direct roll such continuous cast workpieces is illustrated diagrammatically in FIG. 1. The workpiece emerging at the discharge end E of a continuous caster is feed directly in a reheat furnace F. As disclosed in my U.S. Pat. Nos. 4,991,276 and 5,082,047, flexible driven rollers may be used to convey as well as guide the thin cast workpieces along the entire length of the furnace during the reheating process. The required length for such a furnace ranges from at least 300 feet up to 750 feet to heat a required number of continuously cast workpieces when the workpieces each measures 80 to 150 feet long. Because the reheating process is continuous and reheat time is finite for each workpiece multiple workpieces must be heated in the furnace at any given time. Not only must the ends of the workpieces be separated from one another in the furnace to allow orderly processing in the rolling mill M but also a time buffer is needed when the rolling operation is interrupted by the need to service the rolling mill equipment such as conventional roll changing. During such downtime for servicing operations, the workpiece can be oscillated forwardly and backwardly by the driven rollers in the furnace or the speed of the emerging casting from the caster must be slowed; both such measures while providing a time buffer have severe limitations.

The facility illustrated in FIG. 1 requires considering real estate as well as an inordinately long building structure to house the facility. Given that the furnace in FIG. 1 must be 700 feet long there must be also provided an additional distance at each end of the furnace of at least 30 feet for entry and delivery tables to receive the casting at the cutting device from the caster and to deliver the workpiece at the rolling temperate to the first stand of the rolling mill. In a facility of the type illustrated in FIG. 1, the capital investment represented by the rolling mill facility can be utilized to a far greater extent by the supply of workpieces from a plurality of casters. However, the castings emerging from the various casters can not be supplied to the same entry pass-line to a furnace.

An arrangement shown in FIG. 2 is also known in the art and provides separate continuous casters having delivery ends E that supply workpieces cut to finite length by torches T to separate reheat furnaces F each required to have a length of about 700 feet to achieve the required workpiece reheat operations. Furnace sections $S_1$ and $S_2$ are mounted on a track system to allow a lateral shuttle transfer of the furnace sections into alignment with the entry table for the rolling mill M for a time sufficient to empty the furnace of the workpiece and then laterally reposition the furnace section so that the other such furnace is positioned for feeding a workpiece into the entry table of the rolling mill. The addition of the shuttle furnace sections increases the requirement for floor space to accommodate the length of the shuttle furnace which must be slightly greater than the length of the workpiece. For example, when the workpiece is 150 feet long, the shuttle furnace section will be approximately 155 feet long. The shuttle furnace in this instance severs the important function of receiving and holding a workpiece at a desired rolling temperature while a workpiece is discharged from the other of the furnace sections and at the same time accommodates the requirement to bring workpieces from laterally spaced casters into an alignment with a single rolling mill installation. The present invention seeks not only to reduce the required amount of real estate, but also the expense for building structure to house reheat furnace equipment for direct rolling of continuously cast thin workpieces.

Accordingly, it is an object of the present invention to provide a furnace arrangement that will minimize the real estate and building requirements necessary to house the workpiece reheat furnace facilities for direct rolling of the workpieces produced by one or more continuous casting facilities.

It is another object of the present invention to provide a furnace arrangement for reheating thin, continuously cast workpieces for processing in a hot rolling mill in which two streams of continuously cast workpieces are merged seriatim to a holding furnace to at least minimize loss of latent heat of the continuous casting process and deliver the workpiece in a serial fashion to a reheat furnace for heating workpieces to a desired rolling temperature at the entry side of a hot rolling mill.

It is further object of the present invention to provide a reheat furnace for receiving a succession of continuously cast workpieces having a finite length and a hot core in which each workpiece is held at a preselected one of a plurality of vertically spaced sites within a furnace enclosure until such time as such workpiece can be discharged upon attaining a desired elevated temperature suitable for hot rolling operations.

SUMMARY OF THE INVENTION

According to the present invention there is provided a reheat furnace for elongated metal workpieces, the furnace including the combination of furnace walls defining a vertically extending heating chamber having a length to receive horizontally extending workpieces, means for advancing a workpiece along the length of the heating chamber, rows of vertically spaced carriers in the heating chamber for supporting workpieces in a vertically spaced apart relation to one another, and means for transporting a workpiece between the means for advancing a workpiece and one of the carriers.

According to another aspect of the present invention there is provided a method for producing a hot rolled steel product including the steps of producing a workpiece by continuous casting having a finite length and a hot core consisting of latent heat from the continuous casting process, transporting such workpiece to a heating furnace, arranging a plurality of such workpieces at vertically apart sites in the heating furnace, heating the plurality of workpieces in the heating furnace to a predetermined elevated temperature suitable for hot rolling, recovering a heated workpiece from one of the vertically spaced sites, transporting the recovered workpiece from the furnace to an entry table of a hot rolling mill, and hot rolling the heated workpiece in the rolling mill to form a hot rolled steel product.

A still further aspect of the present invention provides a reheat furnace for elongated metal workpieces, the furnace including the combination of furnace walls defining a vertically extending heating chamber having a length to receive horizontally extending workpieces, means for advancing a workpiece along the length of the heating chamber, rows of vertically spaced carriers in the heating chamber for supporting workpieces in a vertically spaced apart relation to one another, and means for transporting a workpiece between the means for advancing a workpiece and one of the carriers.

Another aspect of the present invention provides a method for producing a hot rolled steel product, the method includes the steps of producing two streams of continuous castings having at least solidified outer layers, subdividing the emerging casting from of each of the two streams to form two streams of workpieces having finite lengths and a hot core of latent heat of the continuous casting process, loading seriatim workpieces of the two streams of workpieces from opposite sides of a first furnace into the first furnace, forming a serial stream of workpieces from the first furnace to a heating furnace, simultaneously heating a plurality of workpieces from each of the serial streams in the heating furnace, discharging a heated workpiece from the heating furnace after heating therein to a predetermined elevated temperature suitable for hot rolling of the workpiece, and hot rolling the heated workpiece in a rolling mill train to form a hot rolled steel product.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENTS

Figures 1, 2, 3, 4:
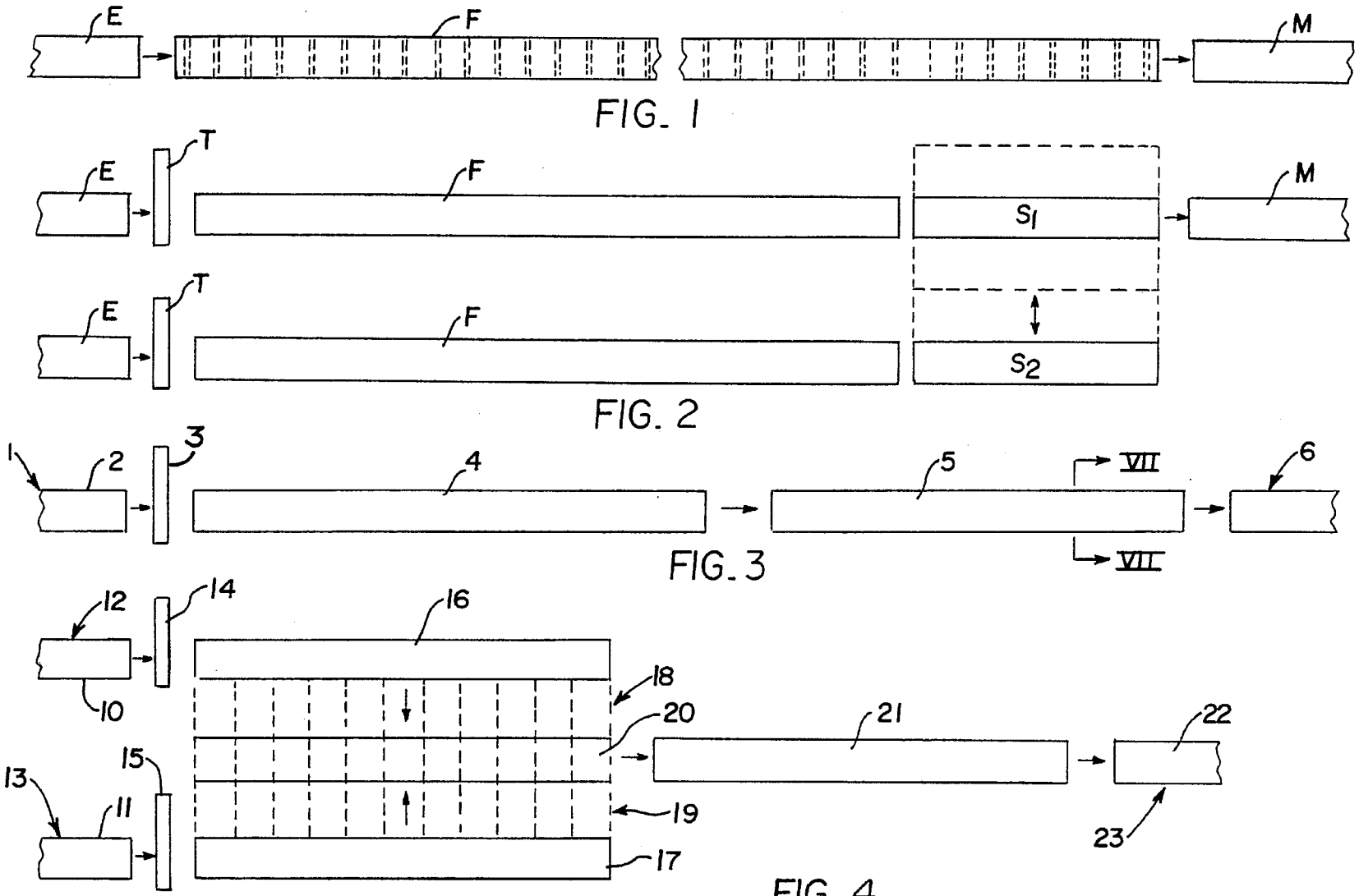
FIG. 1 is a diagrammatic illustration of a prior art arrangement of a reheat furnace having a flow path aligned with a continuous caster for workpieces and the entry end of a hot rolling mill.
FIG. 2 is a diagrammatic illustration of a second reheat furnace arrangement according to the prior art in which two continuous casters supply workpieces separately to a system of holding furnaces for supply through operation of a shuttle transfer of holding furnaces to the entry side of a hot rolling mill.
FIG. 3 is a diagrammatic illustration of a single caster to supply finite workpieces to a reheat furnace embodying the features of the present invention.
FIG. 4 is a diagrammatic illustration of a preferred embodiment of a reheat furnace for supplying reheated workpieces to a hot rolling mill from two continuous casters.

In FIG. 3 there is illustrated a simplified arrangement of facilities to produce a hot rolled steel product according the present invention. In this embodiment there is a continuous caster 1 that receives a supply of molten steel and produces a continuous casting comprising a thin cast e.g., a thin cast slab or a conventional cast slab. The casting emerging from the caster passes a cut-off device 3 which operates to sever the casting to predetermined finite lengths. A dwell time exists while the leading end of the casting passes the cut-off device and to protect against an unwanted loss of heat of the casting a holding furnace 4 protectively houses the casting throughout its movement until the cut-off device operates to define its finite length. The casting is then advanced along a roller hearth of the holding furnace to emerge therefrom and enter through a opening exposed by a moveable door and an end wall of a heating furnace 5. The workpiece is received in the heated furnace on a roller hearth which advances the workpiece in the direction of its length to a point where it is wholly located within the length of the furnace, thus the furnace length substantially corresponds to the length of the workpiece. The details to the construction of the heating furnace are shown in FIGS. 7–14 and will be described in greater detail hereinafter. A plurality of such workpieces is simultaneously heated in the heating furnace and when a desired temperature is attained for a hot rolling process, that workpiece is removed from the furnace and delivered to the entry end of a hot rolling mill 6. The hot rolling mill is per se well known in the art.

Referring now to FIG. 4, there is illustrated delivery tables 10 and 11 of side-by-side continuous casters 12 and 13, each continuous caster being of a type per se well known in the art and produces from a supply of molten steel a continuously cast product that is thin as to its thickness in relation to its width and is sometimes referred to in the art as a thin cast slab. The continuously cast workpiece may be a continuously cast slab having a thickness within a range of 4 to 10 inches. The cast product typically will have a thickness of between 2 and 4 inches and a width of between 24 and 70 inches. The cast products passing from the delivery tables have a solidified outer shell surrounding a hot core that is also solidified but at a significant higher temperature than the shell. The continuous casting passing from each deliver table moves at a speed of about, for example, 190 inches per minute, which is significantly greater by a factor of 5 or more than the casting speed of a conventional 10 inch thick slab. The streams of continuous castings are severed to finite lengths while passing cutoff devices 14 and 15 during their respective movement from tables 10 and 11 to holding furnaces 16 and 17.

Figure 6:
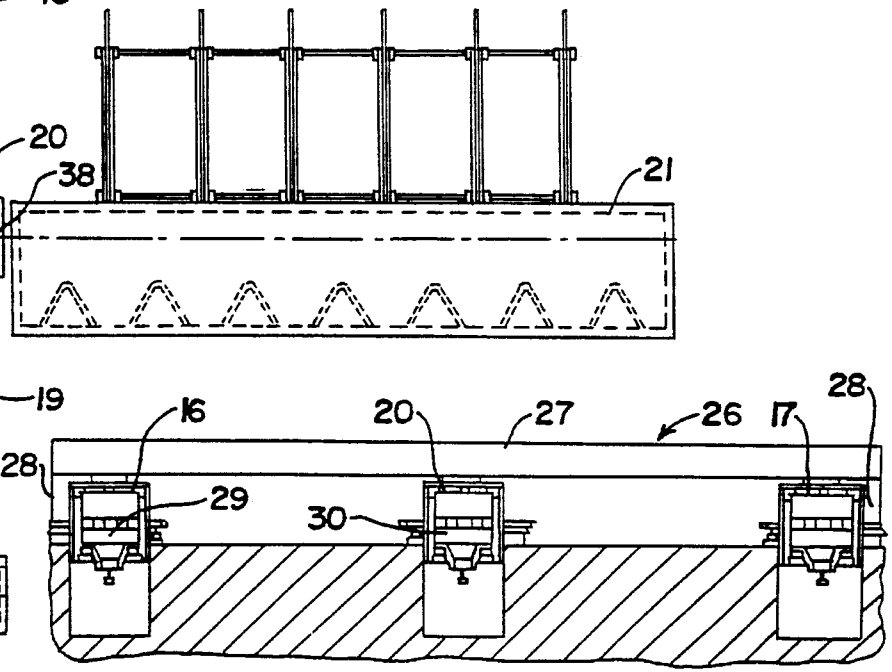
FIG. 6 is sectional view taken along lines VI—VI of FIG. 5.
Figure 5:
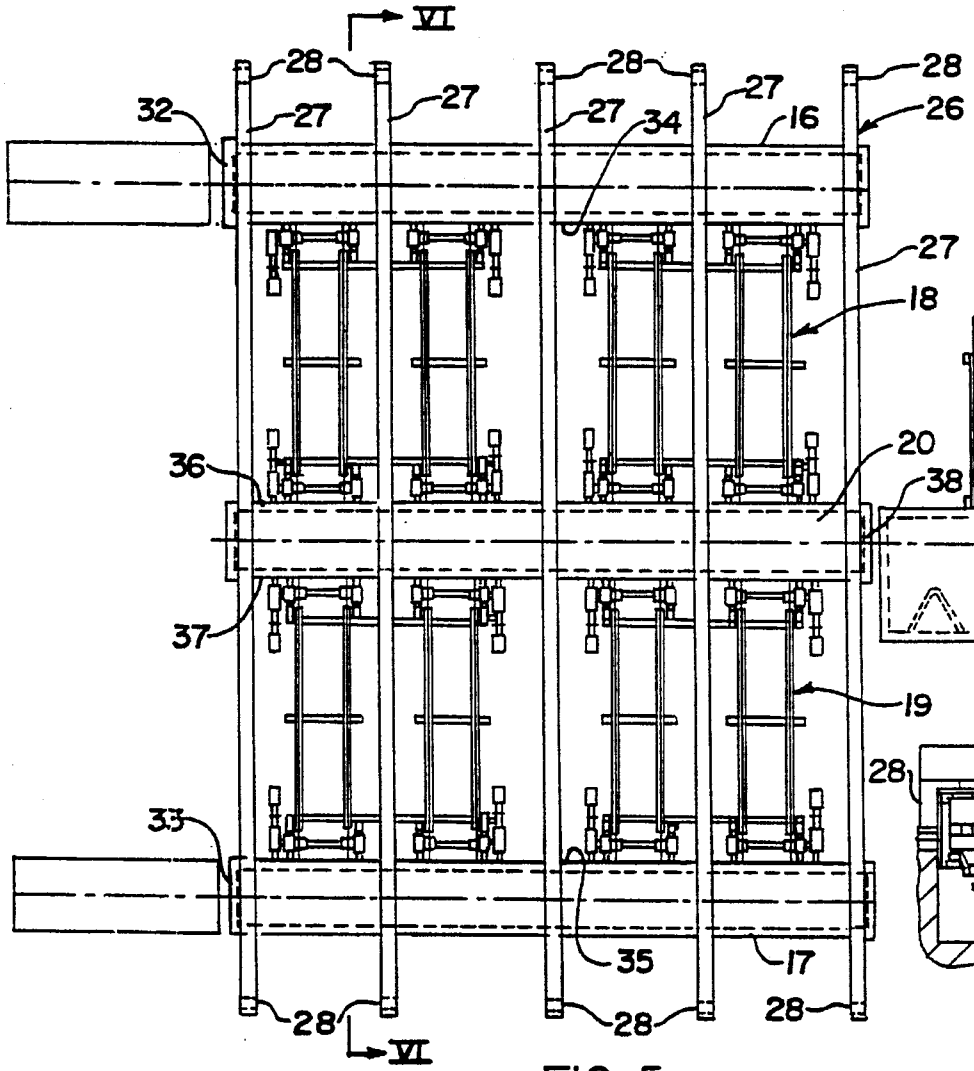
FIG. 5 is an enlarged plan view of the embodiment of holding furnaces and transfer equipment shown in FIG. 4.

A significant feature of the present invention provides that the holding furnaces each have a length generally corresponding to the length of the finite casting when cut from the upstream part of the casting by the respective cutoff device. Specifically, for example, each of the holding furnaces 16 and 17 will have a length of about 155 feet when the finite length of the continuously cast workpiece is established at 150 feet. The holding furnaces function to retard the loss of heat from the continuous casting process. The favorably influence to the unwanted loss of heat by the holding furnaces may include burners within the holding furnaces. Since the casting process requires a period of time to complete a formation of the required workpiece length, the holding furnace avoids undue cooling to the leading end portion of the workpiece. Extractors 18 and 19 which can take the form of chain transfers, peel bars or other well known forms of furnace extractor equipment transfer the workpiece laterally from the holding furnaces 16 and 17 to a central holding furnace 20. The transfer process is seriatim such that a workpiece received in furnace 20 from furnace 16 will be followed by receipt of a workpiece from furnace 17 in furnace 20. Furnace 20 like furnaces 16 and 17 is a holding furnace and houses the workpieces to prevent heat loss during conveyance of a workpiece by driven rollers forming a rotary hearth therein to a reheat furnace 21. The details of the construction of the holding furnace 20 are shown in FIGS. 5 and 6 and will be discussed hereinafter. The workpiece passing from holding furnace 20 is received in a roller hearth section of the reheat furnace 21 for heating a plurality of such workpieces during suitable residence times in the high temperature environment of the furnace to a predetermined temperature which is suitable for carrying out hot rolling operations. After a workpiece obtains the desired temperature for rolling, it is discharged from the furnace to an entry table 22 of a hot rolling mill 23. A feature of the present invention resides in the use of the reheat furnace 21 with a length required to accommodate the predetermined length of the workpiece and a furnace width to allow side by side transfer of a workpiece by a roller hearth along one side of the heat zone wherein individual workpieces are stacked in a vertically spaced relation. With respect to the required furnace length, when the workpiece is 150 feet long then the reheat furnace will have a length slightly greater such as 155 feet. The furnace arrangement shown in FIG. 4 requires a length of floor space within a building of about, for example, 360 feet which compares very favorably and reduces by a factor of 2, to a corresponding amount of floor space required by furnace arrangement known in the art and shown, for example, in FIGS. 1 and 2.

In FIGS. 5 and 6 the arrangement of holding furnaces and heating furnace of FIG. 4 are illustrated in greater detail. Furnaces 16, 17 and 20 each embody the usual refractory lining supported by an outer metal shell that is in turn supported by buckstays extending along the outer parts of the sidewalls when they project upwardly beyond furnace roof portions where the buckstays are joined with an overhead super structure 26 including horizontally extending beams 27 that span across the tops of the furnaces and join by posts 28 extending downward to anchor sites comprising foundation supporting bases. As can be seen in FIG. 5, the beams 27 are spaced apart at regular intervals along the lengths of the furnaces 16, 17 and 20. The use of the super structure 26 to support the furnaces enhances the furnace construction and allows roller hearth 29 and furnace 16; roller heart 30 and furnace 20; and roller hearth 31 and furnace 17 to be supported by individual foundations. Furnaces 16 and 17 may have doors 32 and 33, respectively, when desired, at the ends of the furnaces facing the continuous caster which are selectively opened to allow entrance of a casting emerging from the associated caster. Once the casting is housed in the furnace, the door may be closed to maintain the high temperature furnace environment within the furnace. As discussed previously, burners may be arranged at spaced apart locations in the furnace walls to form heat sources. Furnaces 16 and 17 each have a longitudinal sidewall wherein there is located along the entire length of the sidewall furnace doors 34 and 35, respectively, that allow a lateral transfer of the workpiece from the furnace hearth by an associated extractor 18. The doors 32, 33, 34 and 35 preferably embody a construction well known, per se in the art. A preferred source for such doors is from Aucmet, Inc. of McMurray, Pa., and sold under the tradename "perma close doors". Furnace 20 has doors 36 and 37 along each of its longitudinal sides to allow seriatim passages of a workpiece removed from furnaces 16 and 17 into furnace 20. Workpieces are discharged from furnace 20 in a serial fashion through a opening end thereof, normally closed by doors 38 to allow passage of the workpiece to a rotary hearth of heating furnace 21. Door 38 as well as doors 36 and 37 may also comprise the aforesaid permaclose doors.

Figures 7, 11, 12, 13:
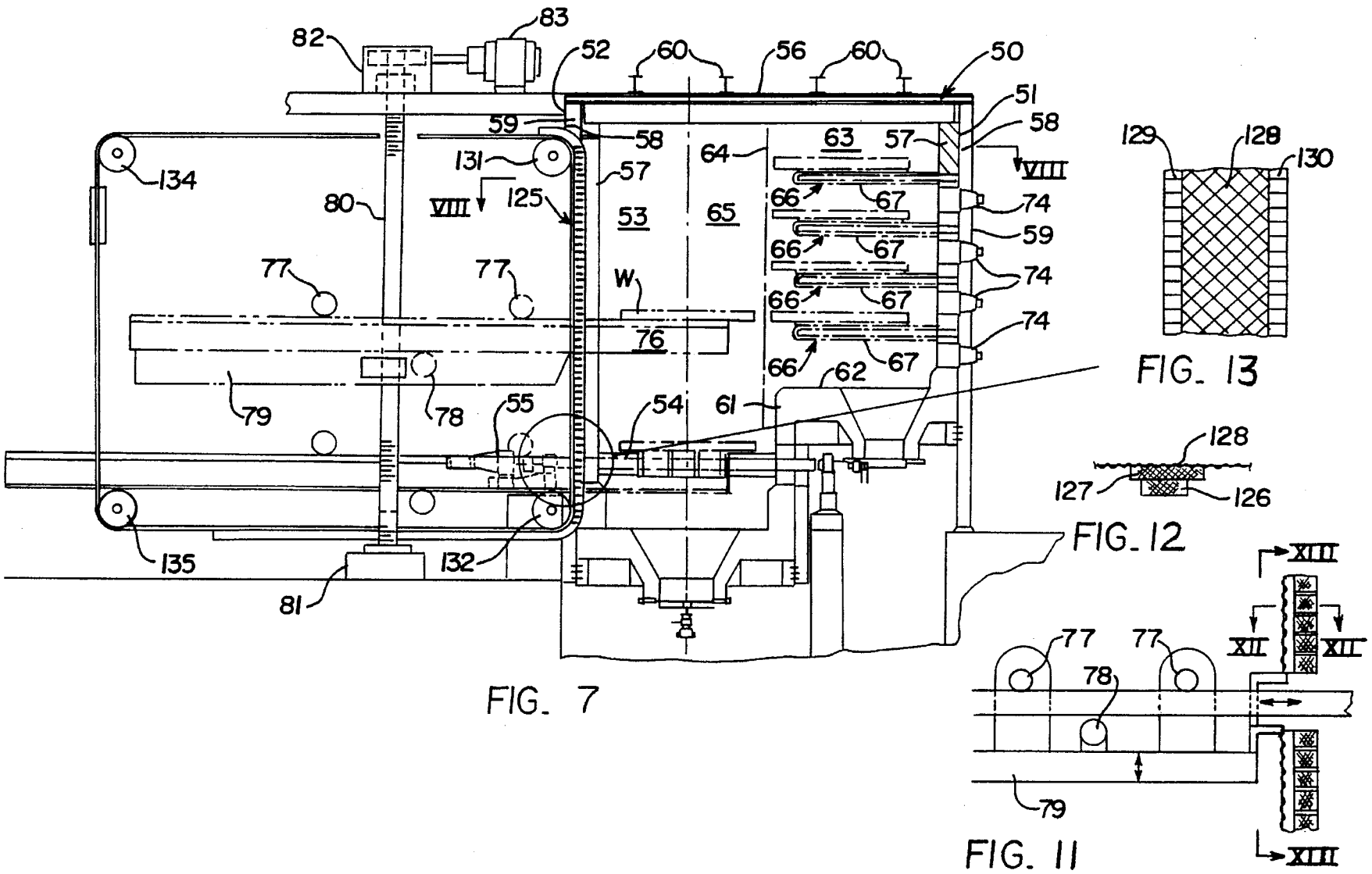
FIG. 7 is a sectional view taken along lines VII—VII of FIG. 3 illustrating a preferred embodiment of a reheat furnace.
FIG. 11 is an enlarged fragmentary view in elevation of the drive structure for the workpiece handling bar forming part of the reheat furnace shown in FIG. 7.
FIG. 12 is a sectional view taken along lines XII—XII of FIG. 11.
FIG. 13 is an elevational view taken along lines XIII—XIII of FIG. 11.

The details of the construction of a preferred embodiment of a heating furnace 50 suitable to form reheat furnace 21 of the embodiment of FIG. 4 as well as heating furnace 5 in the embodiment of FIG. 3 are shown in FIGS. 7–14. The furnace includes spaced apart refractory side walls 51 and 52 having a length corresponding to but slightly greater than the length of workpieces to undergo heating in the furnace. The furnace also includes end walls 53, only one of which is shown in FIG. 7, having doors that can be selectively opened to allow passage of a workpiece into the furnace where into a furnace for support by a hearth which includes spaced apart roller assemblies 54. The roller assemblies each include a journal member extending in opposite directions through suitable openings in the refractory side walls 51 and 52 where bearing supports are rotatably support the rolls while connected to drive motors 55. The rollers 54 may be constructed in a manner disclosed in my U.S. Pat. No. 4,991,276 or according to the construction shown in my co-pending patent application Ser. No. 07/740,147 which is incorporated herein by reference hereto. The sidewalls 51 and 52 and walls 53 as well as roof 56 embody a usual heat resistant furnace construction that includes an inner lining of refractory 57 supported by an outer metal shell 58 that in turn receives structural support from buckstays 59 at horizontally spaced locations along the side walls. Structural members 60 provide support for the roof 56.

Figure 8:
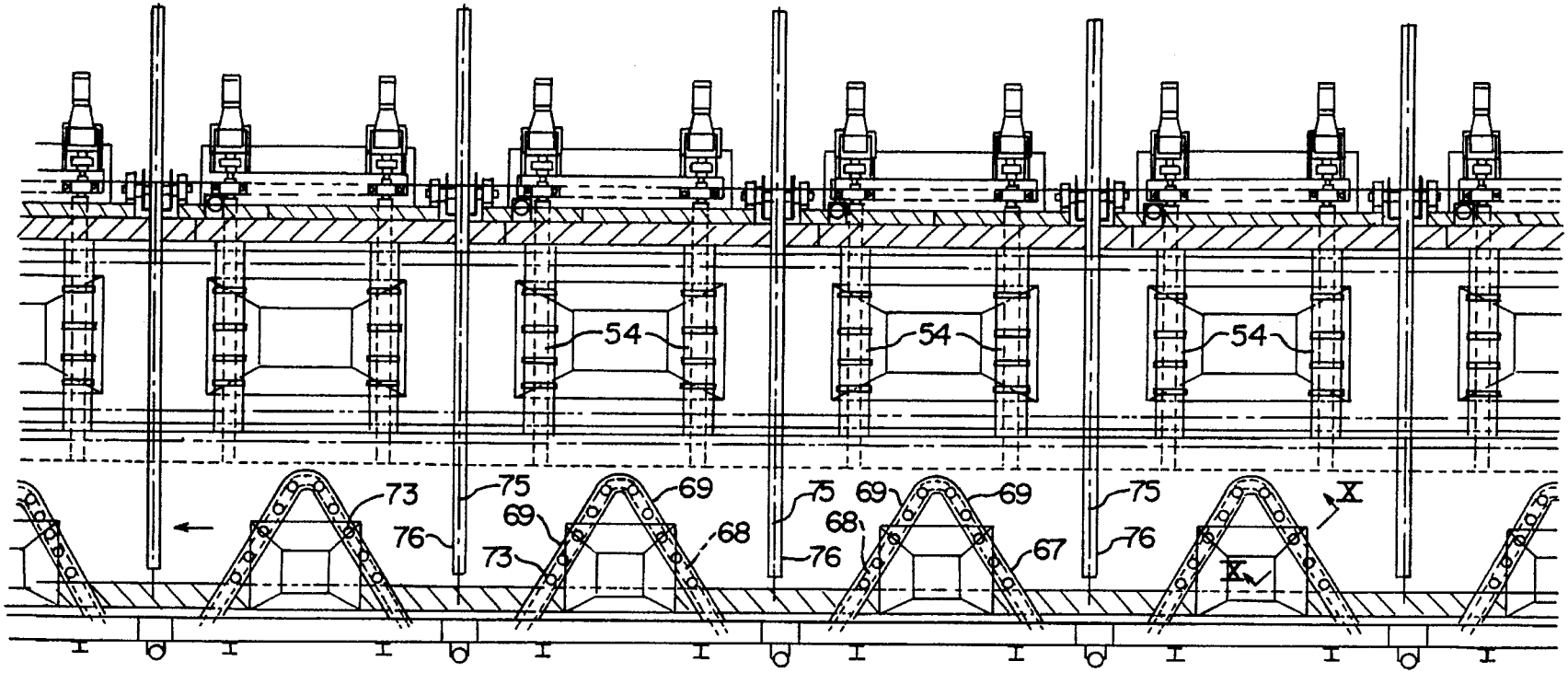
FIG. 8 is a sectional view taken along lines VIII—VIII of FIG. 7.
Figure 10:
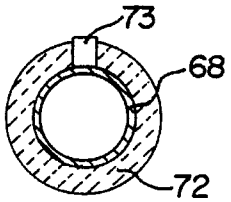
FIG. 10 is a sectional view taken along lines X—X of FIG. 8.
Figure 9:
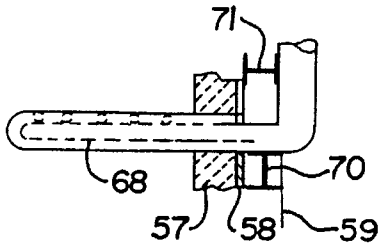
FIG. 9 is a sectional view taken along lines IX—IX of FIG. 8.

As can be seen in FIG. 7, the rollers 54 on the rotary hearth have a face length slightly greater than the width of the workpiece W supported thereon. The hearth terminates at an upstanding wall portion which extends to an elevated floor 62 that underlies and forms the base of a heating zone 63. The heating zone has a width slightly greater than the width of workpieces and extends from the inside surface wall 52 to a vertical plane 64. Horizontally beyond plane 64 of the heating zone 63 there is a loading zone 65. The loading zone 65 is bounded at its base by the rotary hearth and extends upwardly therefrom along the entire height of the heating zone. In the heating zone 63 there extends in acantilever fashion from wall 52 a plurality of rows 66 of aligned workpiece supports 67. The details of which are best shown in FIGS. 8, 9 and 10. Heat support 67 is comprised of a bent pipe 68 which forms an acute angle at its most inwardly projecting part from which there extends leg portions 69 that pass through spaced apart openings in the refractory lining and metal shell of side wall 52. At the points where the leg portions 69 emerge from the side wall the leg portions traverse a horizontal support 70 (FIG. 9) which provides load bearing support to the carriers. Outwardly beyond support 70 the legs 69 have bent portions that extend vertically along other supports 71 which also extend beyond the buckstays and supply support that resists a bending moment imparted to the carriers by the weight of the workpiece thereon. The upturn portions of the legs externally of the furnace have jumper pipe headers or the like to supply liquid coolant for passage along the tubular part of the carriers. Inside the furnace, the legs 69 are encased with insulation 72 except for spaced apart sites where vertically extending heat resistant pads 73 protrude from the insulation and define the actual contact areas with the downwardly directed face surface of a workpiece.

As shown in FIG. 7, between the rows 66 of supports there is arranged in the side walls 52 rows of burners 74 which operate to establish and maintain a highly heated environment within the heating zone.

As can be seen from FIG. 8, the bent configuration of the supports avoids contacting the workpiece along areas transverse to the workpiece so as to minimize affects of cold spots during the hot rolling operation.

As shown in FIG. 8, legs 69 of each carrier intersect with vertical planes containing the rotational axis of roller assemblies 54 forming part of the hearth and residing in the loading zone 65. The vertical planes which contain the rotational axis of the rollers as well as legs 69 are spaced apart by a distance sufficient to accommodate vertical as well as horizontal movement in a vertical plane 75 by transport arms 76. The transport arms operate exclusively within vertical planes 75 to receive a workpiece from the rollers of the hearth lifted vertically in the loading zone 65 and then move it horizontally from zone 65 to heating zone 63 where it is deposited into supporting engagement with one of the rows 66 of supports 67. Similarly, after the workpiece attains a desired temperature suitable to carryout the hot rolling process, the transport arms are removed to retrieve the workpiece from its supporting engagement with a row of carriers and deposit it in the transport zone on the rollers of the hearth. For this purpose, transport arms 76 are provided with an extended length arranged so that the workpiece engaging part of the arms extends through a vertically extending slot in the side wall 51 of the furnace. The portion of the arms externally of the transport zone are supported by spaced apart rollers 77 above the arms and a drive roller 78 below the arms. The drive rollers 78 have gear teeth on their outer periphery that engage with rack gear segments on the underside of the arms such that operation of drive motors propel the arms to and fro between the loading zone 65 and the heating zone 63. Drive roller 78 and its associated motor are supported by a platform 79 that also carries a frame used to support a nut member while threaded engaged with threads on a vertically arranged drive spindle 80. The lower end of the drive spindle is supported by a thrust bearing on a pedestal 81 while the upper end of the spindle is rotatably supported in a bearing housing 82 and provided with a gear wheel meshing with a worm driven by a motor 83. Rotation of spindles 83 imparts vertical movement to the frame 79 hence also transport arms 76 supported thereby causing the workpiece engaging end of the transport arm to move vertically within the transfer zone 63. This movement is such that the workpiece engaging end of the arts passes in planes 75 below the upper surface of the hearth rollers to allow a workpiece to be advanced by the rollers into the furnace by a loading operation and a heated workpiece can be discharged by the rolls at the completion of a heating operation.

Referring now particularly to FIGS. 11–13 and as described previously, the transport arms operate within a vertical slot in the side wall 51 of the furnace. A moveable seal 125 closes the slot above and below the site of the transport arm. The seal includes a vertically stacked mosque of refractory brick 126 having a width corresponding to the width of the slot and a thickness to extend it into the slot. The bricks are adhered to a face part of vertically ending strips of refractory insulation 127 that have a width greater than the width of the slot to slide along the outer faces of the metal shell of the side wall. A strip of wire mesh, such as that used for conveyor belting 128, supports the insulation 127 along a central portion of the strip and along opposite marginal edges 129 and 130 of the belting 128 there is formed transverse bars at regular intervals forming tooth members that can engage with teeth on upper and lower pulleys 131 and 132. As shown in FIG. 12, the belting is affixed to brackets 133 supported by platform 79 whereby movement of the platform vertically displaces the seal vertically in the slot. The belting extends beyond pulleys 131 and 132 away from the furnace to a second set of upper and lower pulleys 134 and 135 where the belting formed in an endless fashion. When the transport arm moves vertically, brick 126 on insulation 127 is stored at an elevated site and when the transport arm moves downwardly, broken insulation is stored at a site near the pedestal 81.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A method for producing a hot rolled steel product, said method including the steps of:

producing two streams of continuous castings having at least solidified outer layers;

subdividing the emerging casting from of each of said two streams to form two streams of workpieces having finite lengths and a hot cores of latent heat of the continuous casting process;

loading seriatim workpieces of said two streams of workpieces from opposite sides of a first furnace into the first furnace;

forming a serial stream of workpieces from said first furnace to a heated furnace;

transporting such workpieces to said heating furnace;

arranging a plurality of such workpieces at vertically spaced apart sites in the heating furnace;

heating the plurality of workpieces in said heating furnace to a predetermined elevated temperature suitable for hot rolling;

recovering a heated workpiece from one of said vertically spaced apart sites;

transporting the recovered heated workpiece at said predetermined elevated temperature from said furnace to an entry table of a hot rolling mill; and hot rolling the heated workpiece in said rolling mill to form a hot rolled steel product.

* * * * *